US006584952B1

(12) United States Patent
Lagier

(10) Patent No.: US 6,584,952 B1
(45) Date of Patent: Jul. 1, 2003

(54) METHOD AND DEVICE FOR CONTROLLING THE COMBUSTION MODE OF AN INTERNAL COMBUSTION ENGINE

(75) Inventor: Marc Lagier, Argenteuil (FR)

(73) Assignee: Peugeot Citroen Automobiles SA, Neuilly sur Seine (FR)

( * ) Notice: Subject to any disclaimer, the term of this patent is extended or adjusted under 35 U.S.C. 154(b) by 0 days.

(21) Appl. No.: 09/763,550

(22) PCT Filed: Jun. 5, 2000

(86) PCT No.: PCT/FR00/01539

§ 371 (c)(1),
(2), (4) Date: Apr. 20, 2001

(87) PCT Pub. No.: WO01/07769

PCT Pub. Date: Feb. 1, 2001

(30) Foreign Application Priority Data

Jul. 23, 1999 (FR) ..... 99 09617

(51) Int. Cl.[7] ..... F02B 17/00

(52) U.S. Cl. ..... 123/295; 123/305; 701/104; 701/105; 60/274; 60/308

(58) Field of Search ..... 123/294, 295, 123/297, 298–305; 701/104, 105; 60/272–308

(56) References Cited

U.S. PATENT DOCUMENTS 5,094,206 A * 3/1992 Buslepp et al. ..... 123/325
5,108,716 A * 4/1992 Nishizawa ..... 422/171
5,207,058 A * 5/1993 Sasaki et al. ..... 60/284
5,910,096 A * 6/1999 Hepburn et al. ..... 60/274
6,092,507 A * 7/2000 Bauer et al. ..... 123/430

FOREIGN PATENT DOCUMENTS

| | | |
|---|---|---|
| DE | 197 37 375 | 3/1998 |
| DE | 197 19 760 | 11/1998 |
| EP | 0 924 420 | 6/1999 |
| FR | 2746854 | 10/1997 |
| FR | 2752267 | 2/1998 |
| JP | 6-093444 | 11/1995 |

* cited by examiner

*Primary Examiner*—Tony M. Argenbright
*Assistant Examiner*—Johnny H. Hoang

(57) ABSTRACT

Device for controlling the mode of combustion of a controlled-ignition four-stroke petrol engine (1) equipped with a system (2) for the direct injection of fuel into the combustion chamber, with at least one catalytic converter (3) placed in the exhaust line (4) of the engine (1) and with a control system (5) receiving information from sensors (6, 7, 9, 10) relating to the rotational speed and to the load of the engine, to the position of the accelerator pedal, and to the temperatures of the engine and of the exhaust gases, characterized in that the control system (5) includes a device for choosing a priority mode of combustion taking account of the said information and on the basis of an estimate of the combustion efficiency of the various modes available.

16 Claims, 10 Drawing Sheets

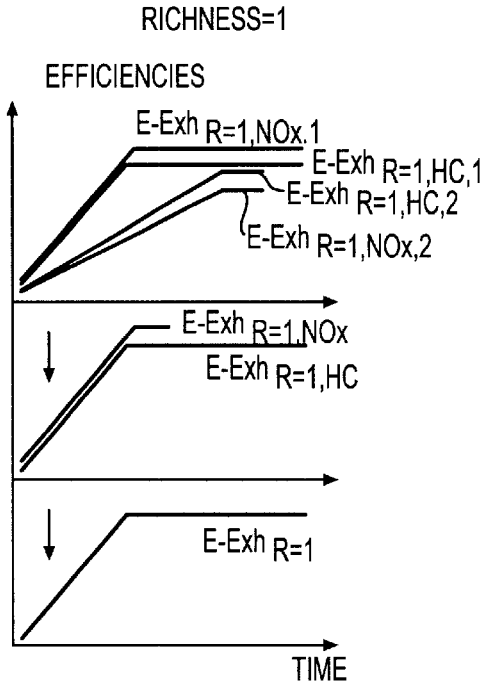
FIG. 9A
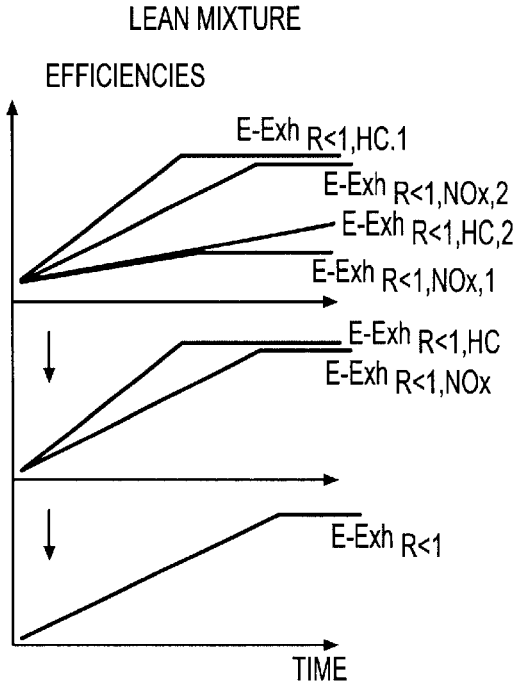
FIG. 9B
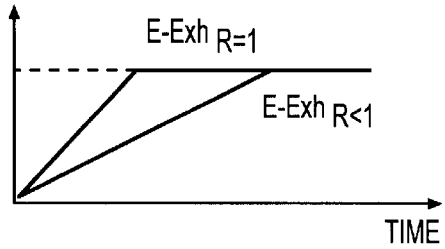
FIG. 9C
FIG. 9

METHOD AND DEVICE FOR CONTROLLING THE COMBUSTION MODE OF AN INTERNAL COMBUSTION ENGINE

FIELD OF THE INVENTION

The invention relates to a method and device for controlling the mode of combustion of an internal combustion engine, and in particular a four-stroke petrol engine.

BACKGROUND

In a controlled-ignition four-stroke petrol engine:

the fuel is injected directly into the combustion chamber via high-pressure fuel supply system;

the control parameters are calculated and applied by a central control unit;

the exhaust gases are treated by one or more catalytic converters placed in the exhaust line.

The engine control unit processes the various demands on the engine (the wishes of the driver, the on-board electronic systems of the course-control or gearbox type, etc.), assimilates them and produces a reference torque value to be achieved by action on the control parameters which are:

the air flow rate the amount of fuel injected the ignition advance applied.

For a direct-injection petrol engine, the engine control unit has various modes of combustion available in order to achieve this reference torque value.

At each instant it has to evaluate the mode of combustion that will produce the best fuel consumption/driveability/exhaust gases clean-up compromise.

SUMMARY OF THE INVENTION

One of the fundamental characteristics of the modes of combustion is the richness of the air/fuel mixture that they allow.

The richness of the mixture is a dimensionless quantity defined as the ratio between the air/fuel proportions of a stoichiometric mixture and the same air/fuel proportion of the mixture in the mode of combustion considered.

Richness for the mode of combustion $i$=(airflow rate/fuelflow rate) stoichiometric/(airflow rate/fuelflow rate)mode i.

By definition:

the richness is equal to 1 when the mixture is stoichiometric, the richness is greater than 1 when the proportion of petrol in the mixture is greater than that of the stoichiometric mixture. The mixture is said to be "rich", the richness is less than 1 when the proportion of petrol in the mixture is lower than that of the stoichiometric mixture. The mixture is said to be "lean".

The mode of combustion which provides the best efficiency is the so-called "stratified charge" mode.

In this mode, the fuel is injected into the combustion chamber at the end of the compression phase so that the richness of the mixture near the spark plug at the time of ignition is high enough to ensure combustion.

The overall mixture has a very great excess of air (mean richness of the order of 0.4) which allows:

an increase in the combustion efficiency of the engine, an increase in the mean pressure in the intake manifold and thus a reduction in "pumping losses".

The range of use of this mode of combustion is physically restricted by the maximum air-filling of the cylinders, which filling is associated with the maximum pressure in the plenum chamber (full air charge).

This "stratified charge" mode of combustion is therefore favoured for low torque demands but cannot meet all the demands placed on the engine by the driver.

For higher torque demands, there are two modes of combustion that may be employed, both characterized by the injection of fuel into the chamber during the inlet phase.

This injection allows homogenous mixing of air and fuel.

The distinction between these two "homogenous" modes of combustion is in the associated mean richness level:

Lean Homogenous Mode

The mean richness of the mixture is of the order of 0.75.

This mode has the same advantages of the aforementioned stratified charge mode, limited by the overall richness level which has to be high enough to allow combustion of the mixture.

Stoichiometric Homogeneous Mode

The richness of the mixture is equal to 1.

This mode is needed for high demands for engine torque, which demands require high fuel flow rates.

A rich homogeneous mode is also defined for when the engine is running at full load. This mode will not be mentioned here because it is not specific and can be likened to the stoichiometric homogenous mode for the aspects dealt with.

The favoured mode of combustion for optimizing consumption can be represented schematically by the graph of engine torque against engine rotational speed as shown in FIG. 1.

The transition from one mode of combustion to another is to be made with no appreciable affect as far as the driver is concerned.

This constraint entails complex management of the actuators by the engine control unit.

For example, without any specific action by the control unit, the change from one mode of operation with a lean mixture to the homogenous stoichiometric mode of operation would give rise to a sudden and significant increase in torque, which needs to be avoided.

To do this, the engine control unit calculates the air, fuel and ignition advance controls in order at every instant to meet the reference torque value.

This control "by torque" makes it possible to ensure a torque which is equal to the demand from the driver, including in changes of mode.

However, the quality with which the reference torque value is adhered to is dependent on spread which may be brought about by the ageing of engine parts, manufacturing spread or even the varying characteristics of the commercially available fuels.

These variations carry the risk of disrupting the control by torque and thus of making the changes in mode perceptible to the user.

It is therefore important that changes in mode of combustion should be brought about only for lasting changes in the engine operating point.

The influence of the mode of combustion on emissions of pollutants will now be discussed.

Emissions or pollutants from the engine are treated by a catalytic system that forms cart of the exhaust system.

This system may be made up of one or more elements intended to oxidize or to reduce the toxic components of the exhaust gases.

The most dangerous components are unburnt hydrocarbons (HC), carbon monoxide (CO) and the oxides of nitrogen (NOx).

The CO and the HCs need to be oxidized to convert them into $CO_2+H_2O$.

The NOx have to be reduced to be converted into $H_2+O_2$.

When the air-petrol mixture is stoichiometric, the dual function or oxidation and reduction is carried out by a three-way catalytic converter.

When associated with fine adjustment of the richness of the air-fuel mixture allowing the richness to be made to fluctuate by small amounts around 1, this catalytic converter allows excellent overall conversion of the two pollutants.

When the air-petrol mixture is lean, only the oxidation function can be performed by the three-way catalytic converter.

The reduction function can then be provided in various ways:

NOx can be stored while the mixture is lean and then reduced during phases in which the engine is operating at a richness greater than or equal to 1, chemical formulation can be used to allow a reduction in lean mixtures.

Whatever the definition of the catalytic system, its treatment efficiency is very low for as long as its temperature has not reached a threshold light-off temperature at which the chemical reactions begin.

As long as this light-off temperature (of the order of 250°) has not been reached, specific engine management is required in order to:

minimize basic engine emissions as far as possible, increase the temperature of the catalytic system as quickly as possible.

This management favours the clean-up constraint at the expense of fuel consumption. It has therefore to be suppressed as soon as the control unit detects sufficient efficiency for the pollutants to be converted in the mode of combustion that favours consumption.

SUMMARY OF THE INVENTION

The invention aims to create a method and a device for the overall management of the constraints associated with the choice of combustion mode.

The constraints taken into consideration are the fuel consumption, the driveability of the vehicle and the efficiency with which the pollutants are treated as the temperature rises after the engine has been started.

A subject of the invention is therefore a method for controlling the mode of combustion of a controlled-ignition four-stroke petrol engine equipped with a system for the direct injection of fuel into the combustion chamber, with at least one catalytic converter placed in the exhaust line of the engine and with a control system receiving information relating to the rotational speed and to the load of the engine, to the position of the accelerator pedal, and to the temperatures of the engine and of the exhaust gases, characterized in that an estimate of the combustion efficiency of the various modes available is established and, bearing in mind the said information relating to the rotational speed and to the load of the engine, to the position of the accelerator pedal and to the temperatures of the engine and of the exhaust gases, a priority mode of combustion is chosen on the basis of the said estimate of the combustion efficiency of the various modes available.

Another subject of the invention is a device for controlling the mode of combustion of a controlled-ignition four-stroke petrol engine equipped with a system for the direct injection of fuel into the combustion chamber, with at least one catalytic converter placed in the exhaust line of the engine and with a control system receiving, from sensors, information relating to the rotational speed and to the load of the engine, to the position of the accelerator pedal, and to the temperatures of the engine and of the exhaust gases, for implementing the method defined hereinabove, characterized in that the control system comprises means or choosing a priority mode of combustion taking account of the said information and on the basis of an estimate of the combustion efficiency of the various modes available.

According to other features:

the device comprises a control algorithm making it possible to calculate the combustion efficiency taking account of the thermal condition of the combustion chamber;

the control algorithm makes it possible to correct the priority mode of combustion using a switching efficiency capable of anticipating the behaviour of the driver and thus of avoiding ill-timed changes in combustion mode upon discrete changes of priority mode of combustion;

the control algorithm makes it possible to anticipate the behaviour of the driver on the basis of a combined analysis of engine torque reference values before and after the application of filters which are intended to smooth out the transitions in torque in order to make the vehicle pleasant to drive;

the control algorithm makes it possible to correct the mode of combustion taking account of the treatment efficiency of the said at least one catalytic element in the exhaust line as the temperature rises after the engine has been started.

Constraint management is prioritized as follows:

a priority mode of combustion is defined by the minimum consumption criterion.

The performance of a mode of combustion is expressed in the form of a combustion efficiency and the mode of combustion that gives the best efficiency is chosen as the priority mode.

if this priority mode changes, the control unit tests the stability of the new mode over time. The purpose of this test is to detect discrete changes which must not be applied because they might have an effect on the torque that the driver can perceive. Discrete chances are detected by anticipating the behaviour of the driver.

This anticipation is made possible by filtering the wishes of the driver, which filtering is constantly in use in order to smooth the torque demand and thus to guarantee good driveability of the vehicle.

Comparing reference torque values before and after filtering makes it possible to discriminate between mode changes which have to be applied without a time delay and those which must not be applied.

The mode of combustion which takes account of the consumption and driveability constraints is finally compared against the clean-up constraint imposed by the catalysis system.

After the engine has been started, the engine control unit evaluates the efficiency of the treatment of pollutants by the catalysis system.

This estimate of the efficiency, expressed in the form of a conversion efficiency, allows the control unit to impose, during the temperature rise, the mode of combustion which guarantees the lowest level of emissions of pollutants.

Once the nominal operating temperature has been reached, this constraint is taken away and the priority mode of combustion is authorized.

BRIEF DESCRIPTION OF THE FIGURES

The invention will be better understood by reading the description which will follow, given solely by way of example and made with reference to the appended drawings, in which:

FIGS. 9A–9C show an example of the behaviour of the various treatment efficiencies of the exhaust line.

DETAILED DESCRIPTION

Figure 1:
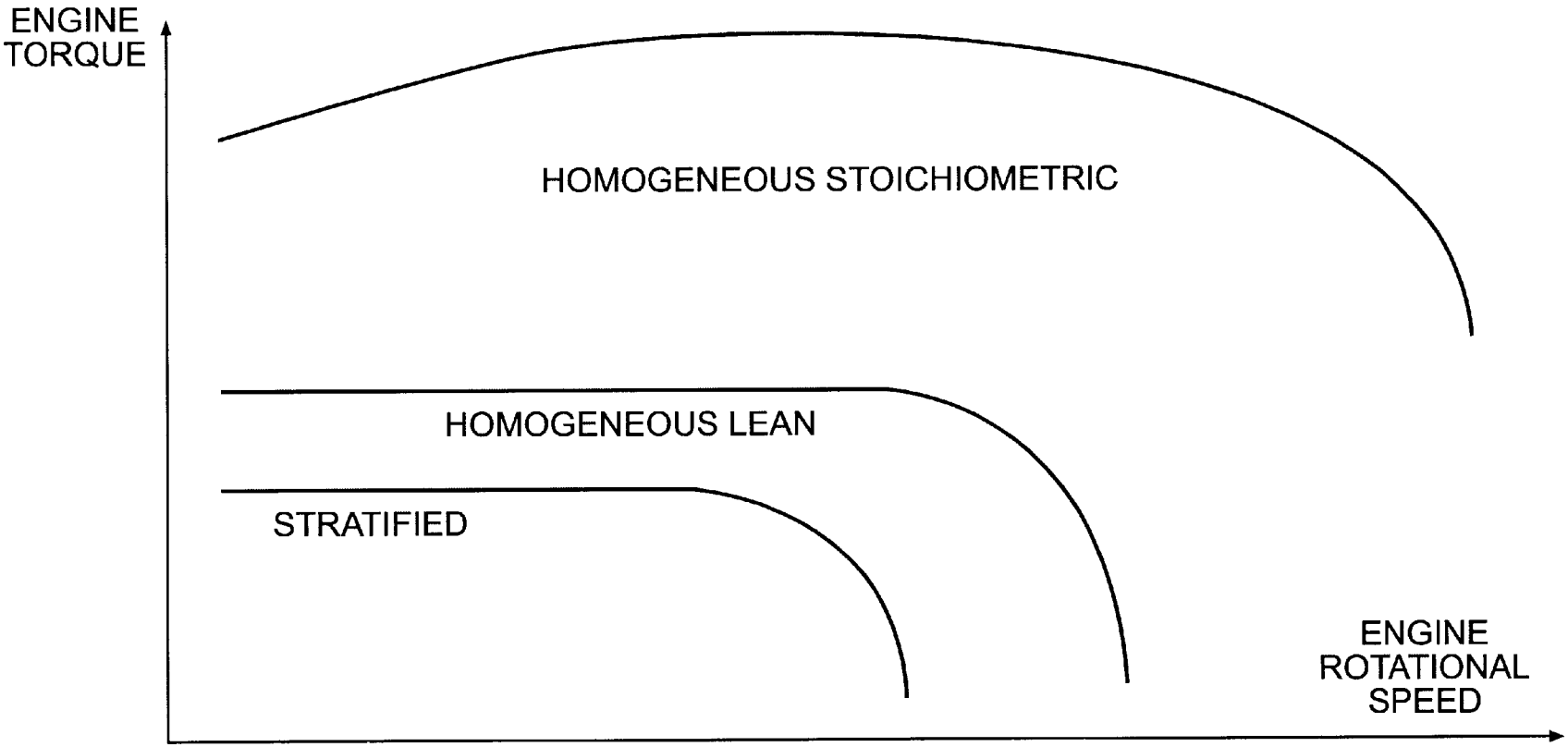
FIG. 1 is a graph of engine torque against the rotational speed of an engine.
Figure 2:
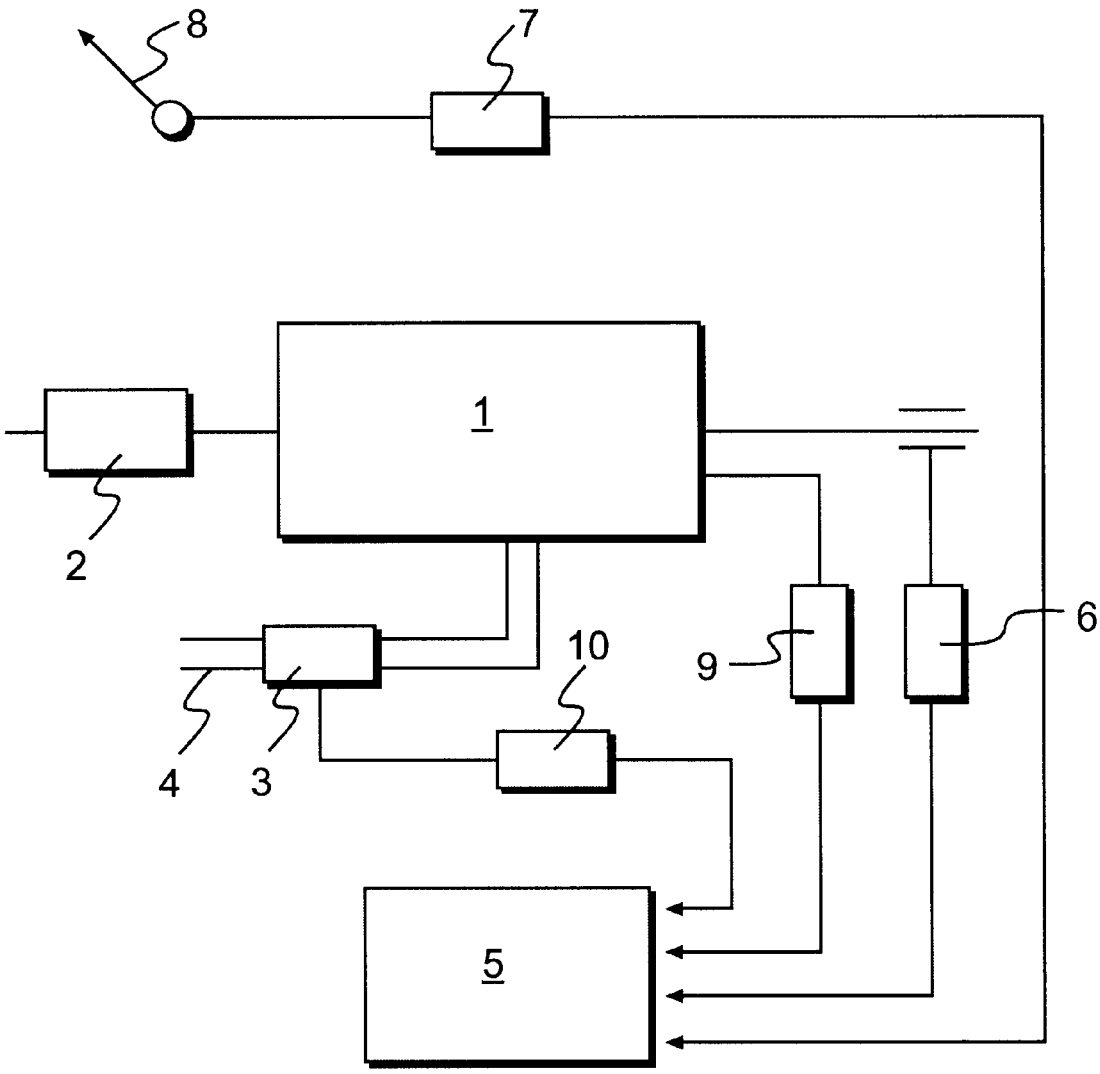
FIG. 2 is a block diagram of a device for controlling the mode of combustion of an internal combustion engine according to the invention.

The block diagram of FIG. 2 depicts a control-ignition internal combustion petrol engine 1, for example a four-stroke engine, equipped with a high-pressure fuel supply system 2 injecting fuel directly into the combustion chamber of the engine, a catalytic converter 3 placed in the exhaust line 4 and a control system 5 connected to a sensor 6 that senses the rotational speed and the load on the engine, to a sensor 7 that senses the position of the accelerator pedal 8, to a sensor 9 that senses the temperature of the engine and to a sensor 10 that senses the temperature of the exhaust gases.

Figure 3:
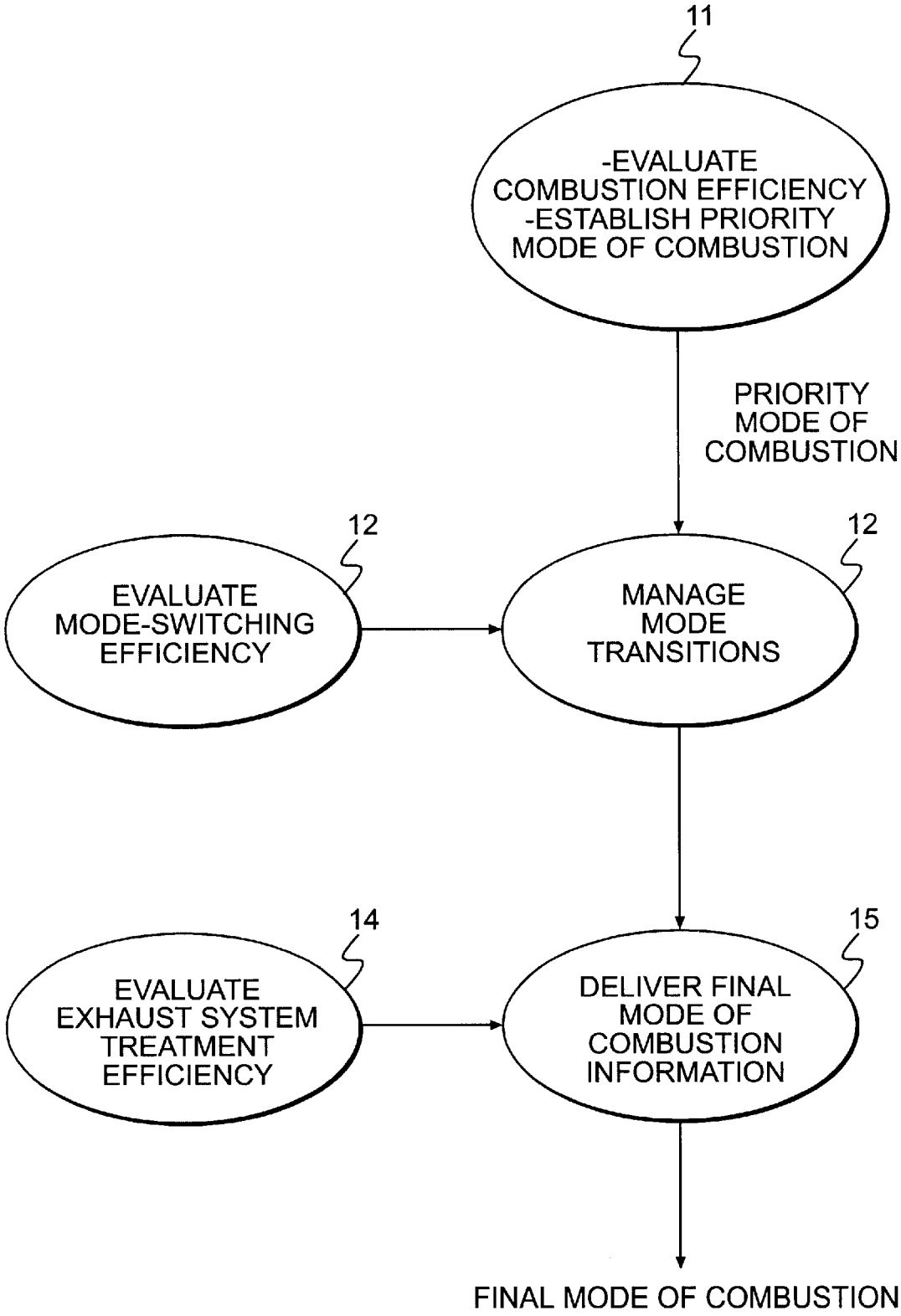
FIG. 3 is a flowchart for working out the mode of combustion.

A brief overview of the working-out of the mode of combustion will now be given, with reference to FIG. 3.

During a step 11, the combustion efficiency is evaluated and the priority mode of combustion is established.

During a step 12, the mode-switching efficiency is evaluated.

During a step 13, the mode transitions are managed on the basis of the data received from steps 11 and 12.

During a step 14, the exhaust system treatment efficiency is evaluated.

During a step 15, the clean-up constraint is taken into consideration and final mode of combustion information is delivered.

The calculation of the combustion efficiency E-Comb will now be described.

The combustion efficiency E-Comb is defined as follows:

$$E\text{-Comb}_i = \text{specific consumption of the engine in mode of combustion } i / \text{lowest specific consumption of the engine for the operating point}$$

By definition, $\text{E-Comb}_i=1$ for the mode of combustion which gives the lowest specific consumption.

By convention, $\text{E-Comb}_i=0$ if the engine operating point cannot be achieved in the mode of combustion i.

The efficiency in mode i is parametrized on the basis of the static mapping performed on the test bed.

It is a function of:

the torque demanded from the engine, the rotational speed, the thermal condition of the combustion chamber ($T°_{chamber}$).

$$E\text{-Comb}_i = F_i(\text{torque, speed}) \times G_i(T°_{chamber}).$$

$T°_{chamber}$ is estimated on the basis of the following physical model:

$T°_{chamber}$=thermal condition of the combustion chamber.

$T°_{chamber}$ is initialized to the temperature of the engine water before the engine is started.

After start-up, $T°_{chamber}$ tends towards a value $T°_{chamber\ stabilized}$.

$T°_{chamber\ stabilized}$ is calculated using the following relationship:

$$T°_{chamber\ stabilized} = F(\text{speed, torque}) \times \text{Ki}$$

F being the fundamental characteristic of the engine.

It is estimated by calculation and corresponds to the nominal operating conditions at 20° ambient in homogeneous mode of combustion with a richness equal to 1.

Ki is a degradation coefficient for modelling the reduction in combustion temperatures for lean mixtures (homogeneous or stratified charge).

The filtering of $T°_{chamber}$ is intended to achieve $T°_{chamber\ stabilized}$.

It is a function of the engine water temperature.

The filter used makes it possible to model the thermal inertia of all the parts that make up the combustion chamber.

The way in which the priority mode of combustion is determined will now be described.

The priority mode of combustion is the one which provides the best combustion efficiency.

For this purpose, the switching efficiency E–Sw is calculated.

The switching efficiency becomes involved only when changing the priority mode of combustion.

The purpose of calculating the efficiency is to avoid repeated changes in mode for slight variations in the torque demanded by the driver in a borderline zone of operation between two modes.

Preliminary Definitions

The initial mode of combustion is 1. The driver increases his demand for torque and $\text{E-Comb}_z$ becomes greater than $\text{E-Comb}_1$ (the same principle car be applied for any variation in the priority mode of combustion).

A distinction is made between two reference torque values.

Craw: reference torque value before filtering by the engine control system to give good driveability;

Cfiltered: reference torque value after filtering by the engine control system to provide good driveability.

For (Cfiltered<C12+DC1), the mode of combustion 1 is capable of supplying the torque demanded (without, by definition, providing the best consumption)

From the reference torque Craw, E–Sw is calculated.

Figure 4:
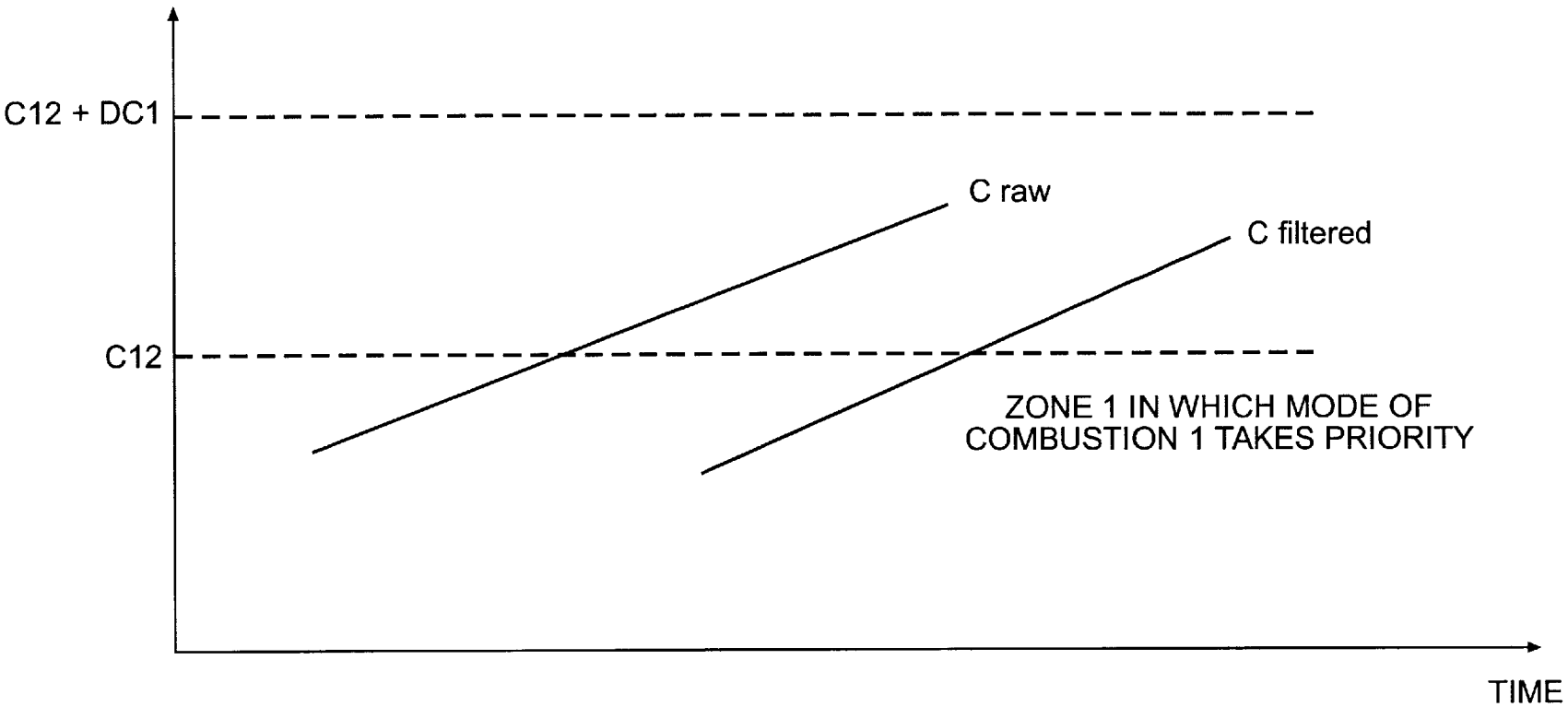
FIG. 4 is a graph of the mode of combustion against time.

E–Sw is initialized at zero when Cfiltered exceeds C12 (FIG. 4).

If the torque before filtering exceeds the maximum torque that can be delivered in mode 1, the change in mode must be made without delay.

If Craw>C12+DC1 then E–Sw=1.

If the torque before filtering remains below the maximum torque that can be delivered in mode 1, the engine control system 5 scrutinizes the variations in the combustion chamber.

If the driver increases his demand for torque, the change in mode is made without delay.

If Craw(n)−Craw (n−1)>DCref1 then E−Sw=1.

The driver stabilizes his demand, E−Sw is incremented and tends towards 1.

If Craw(n)−Craw (n−1)∈[DCref2, DCref1], E−Sw(n)=E−Sw(n−1)+Δ.

If the driver decreases his demand (while at the same time remaining within the domain in which mode 2 provides the best consumption), the change in mode is not made.

If Craw(n)−Craw(n−1)<DCref2, then E−Sw=0.

Figure 5:
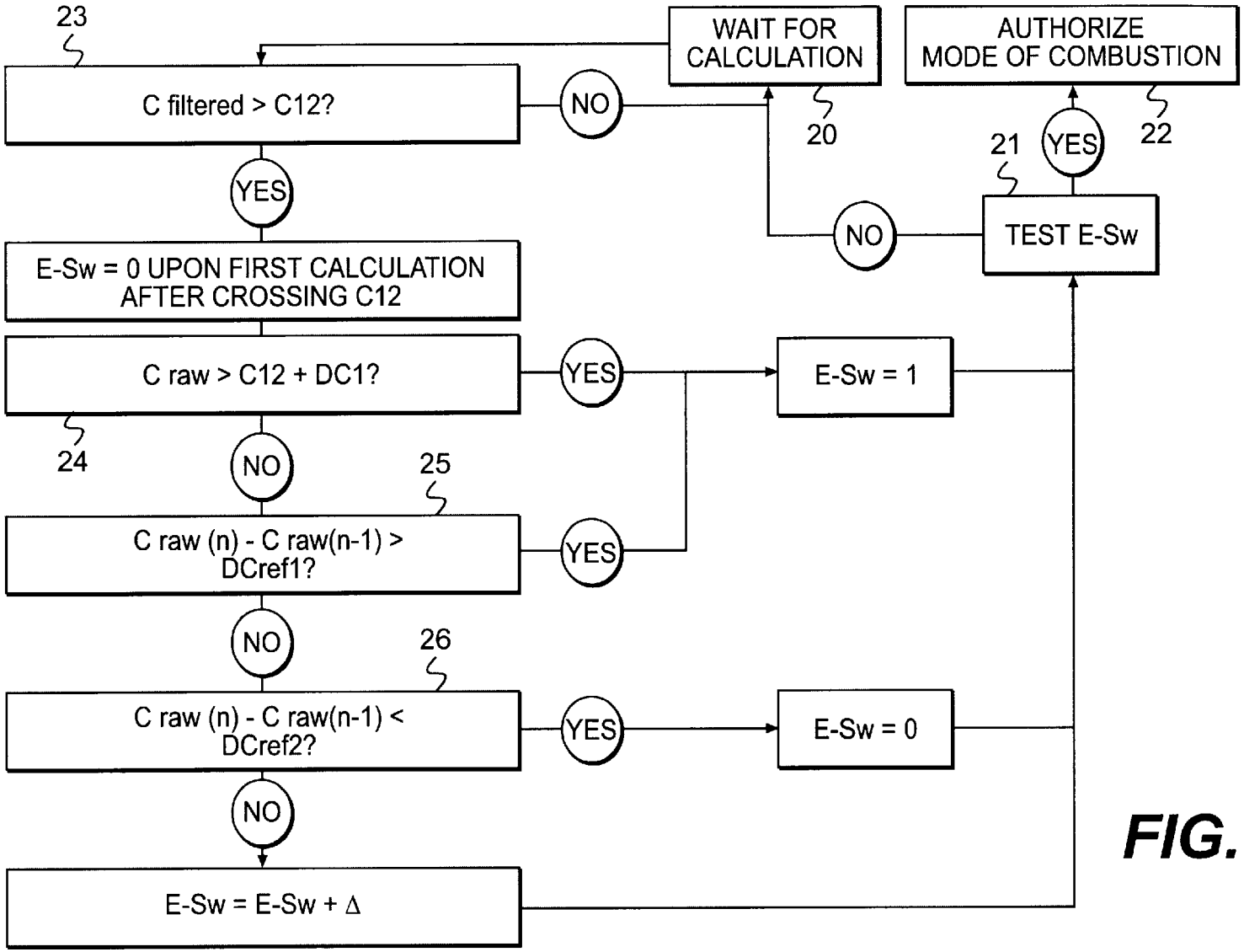
FIG. 5 is a flowchart of the E–Sw calculation algorithm.

The detailed control algorithm that calculates E−Sw stored in memory of the control system 5 is set out in FIG. 5 and will now be described with reference to that figure.

This algorithm comprises a phase 20 of waiting for a calculation step which receives the result of a test on E−Sw carried out during step 21 during which it is checked whether TEST E−Sw=1.

If the answer is yes, the algorithm proceeds to step 22 which authorizes the mode of combustion.

If the answer is no, the algorithm moves on to step 20 which waits for a calculation step.

Then, during phase 23, a test is performed to determine whether Cfiltered>C12.

If the answer is no, the algorithm returns to the waiting step 10.

If the answer is yes, E−Sw=0 on the first calculation after crossing C12, and the algorithm proceeds to test step 24 to determine whether Craw>+C12+DC1.

If it does, E−Sw=1 and the algorithm returns to step 21 to test whether E−Sw=1.

If the answer is no, then the algorithm proceeds to test step 25 to determine whether $$\text{Craw}(n)-\text{Craw}(n-1)>\text{DCref}1.$$

If the answer is yes, the algorithm switches once again to E−Sw=1.

If the answer is no, the algorithm proceeds to step 26 which is a test to determine whether Craw(n)−Craw(n−1) <DCref2.

If the answer is yes, E−Sw=1 and the algorithm returns to step 21 which is the test on E−Sw.

If the answer is no, E−Sw−Esw+Δ.

Figure 6:
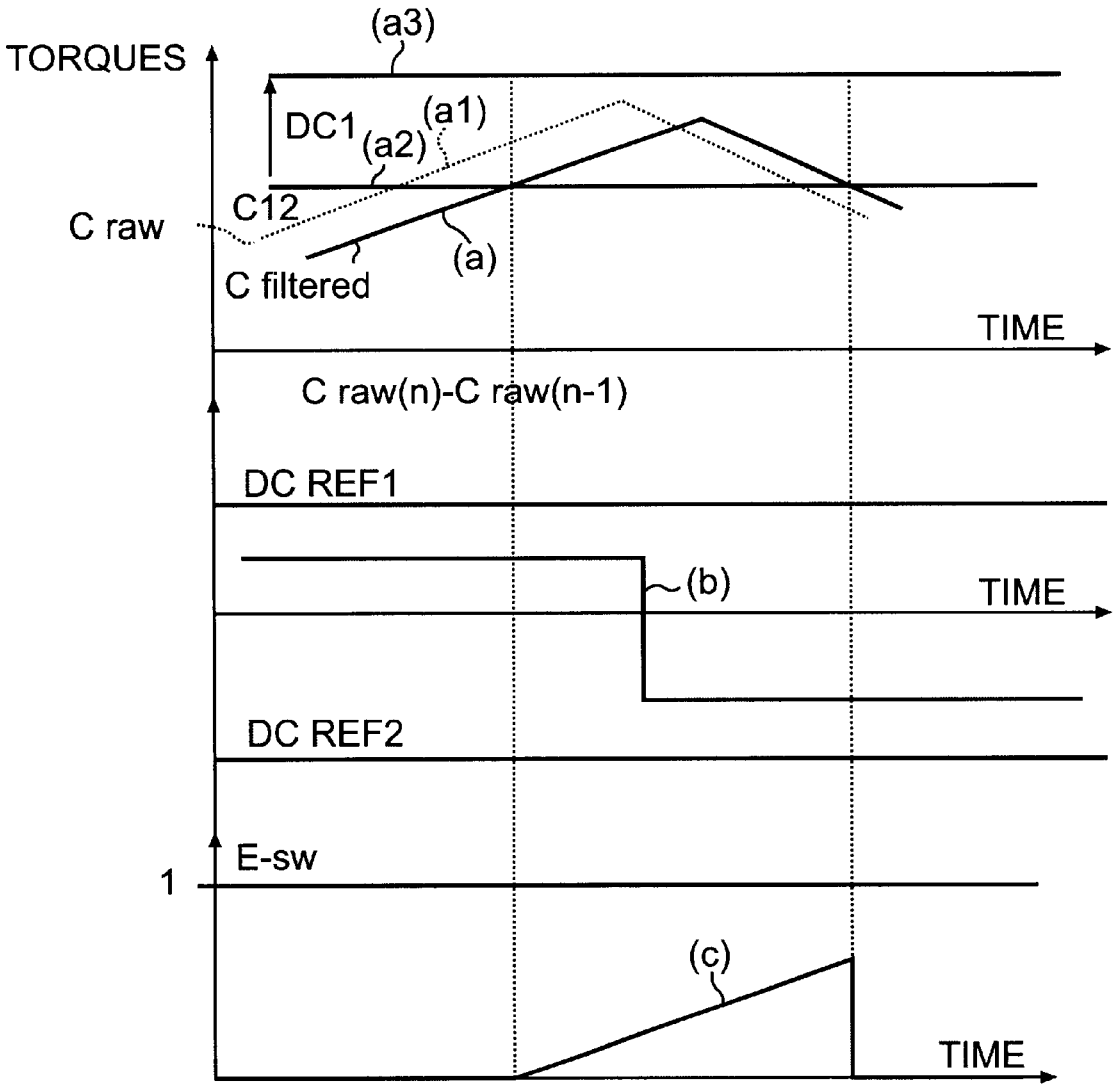
FIG. 6 is a graphic depiction of the discrete change in priority mode of combustion.
Figure 7:
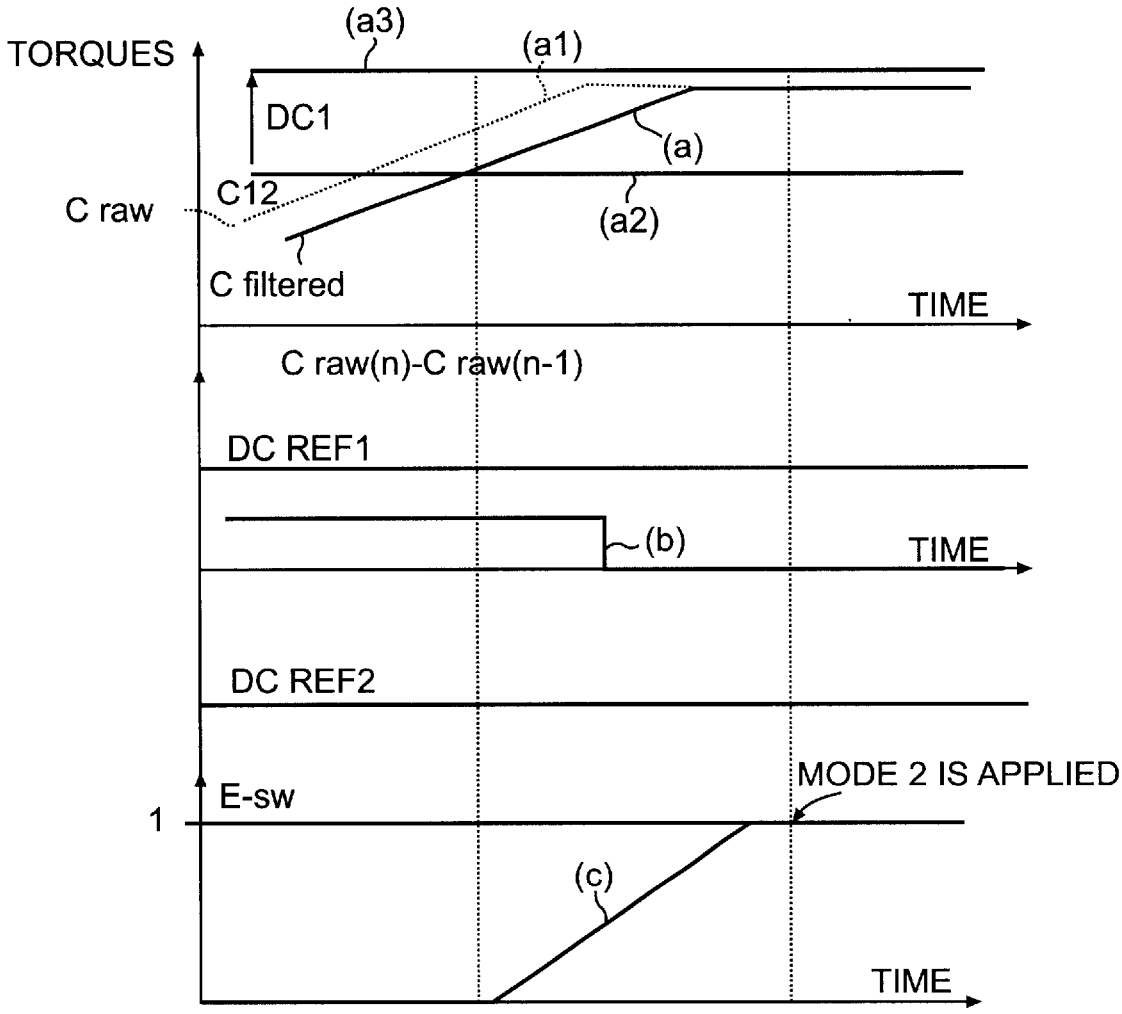
FIG. 7 is a graphic depiction of the confirmed change in priority mode of combustion on E–Sw.
Figure 8:
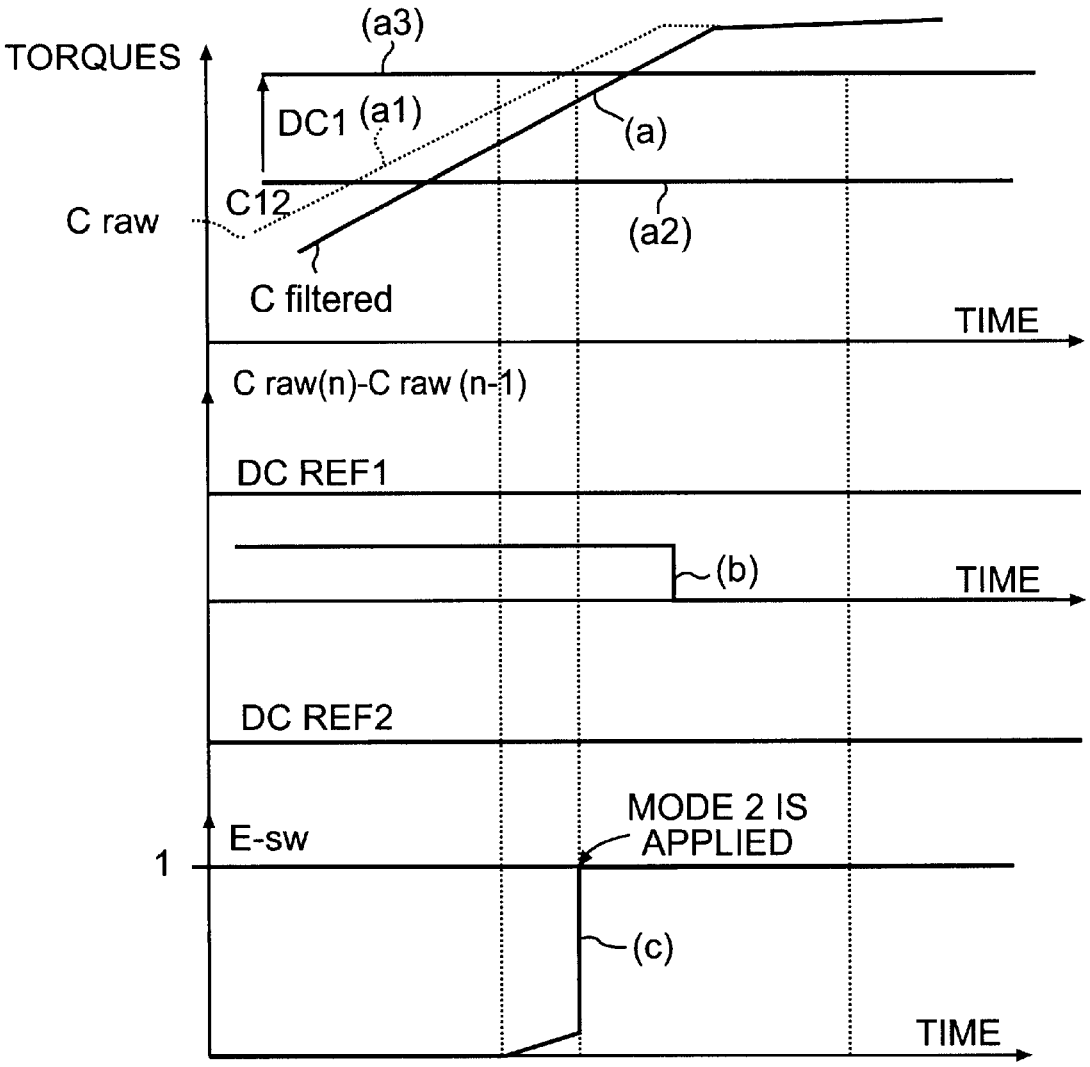
FIG. 8 is a graphic depiction of the confirmed change in priority mode of combustion upon sharp acceleration by the driver.

Various examples of the behaviour of E−Sw are depicted in FIGS. 6 to 8.

FIG. 6 depicts a discrete change in the priority mode of combustion, that the strategy described makes it possible to avoid.

The graph of FIG. 6 represents the values of torque against time.

Curve (a) in solid line shows the change in the value Cfiltered over time.

The curve (a1) in dotted line shows the corresponding change in Craw.

The straight line (a2) parallel to the time axis represents C12.

The straight line (a3) parallel to the time axis represents DC1+C12.

The curve (b) extending in the form of a stepped line on each side of the time axis, represents the value of Craw(n)−Craw(n−1).

The curve (c) represents the variation in E−Sw.

FIG. 7 represents the confirmed change in priority mode of combustion or the condition E−Sw=1.

The curve (a) in solid line represents Cfiltered, the curve (a1) in dotted line represents Craw.

These two curves intersect the constant value of C12 represented by the straight line ($a_2$). The horizontal line ($a_3$) represents DC1.

The curve (b) represents Craw(n)−Craw(n−1).

The curve (c) represents E−Sw. It can be seen from this curve that the mode of combustion 2 is applied when E−Sw reaches 1.

FIG. 8 represents the confirmed change in priority mode of combustion upon sharp acceleration by the driver.

The curve (a) in solid line represents the change in the value of Cfiltered.

The curve (a1) in dotted line represents that of Craw.

The curves a2 and a3 represent the constant values of C12 and DC1.

The curve (b) represents Craw(n)−Craw(n−1).

The curve (c) represents E−Sw.

Mode 2 is applied when Craw reaches the value of DC1.

The use of E−Sw is as follows:

For as long as E−Sw<1, if Cfiltered crosses C12, this does not bring about a change in mode of combustion (FIG. 6)

If E−Sw=1, the change in mode of combustion is made (FIGS. 7 and 8).

The calculation of the efficiency of the catalytic treatment of the exhaust line E-Exh will now be described.

The efficiency is modelled as a function of:

the pollutant considered (HC, NOx), the mean richness of the exhaust gases (and therefore, by implication, of the mode of combustion), the temperature of the catalytic element or elements in the exhaust line.

By convention:

$T°_i$=temperature of the element i of the exhaust line.

$E\text{-}Exh_{R=1,NOx,i}(T°_i)$=efficiency of the treatment of NOx for richness 1 by the element i $E\text{-}Exh_{R=1,HC,i}(T°_i)$ efficiency of the treatment of hydrocarbons for richness 1 by the element i $E\text{-}Exh_{R<1,NOx,i}(T°_i)$=efficiency of the treatment of $No_{x\ for}$ richness less than 1 by the element i $E\text{-}Exh_{R<1,HC,i}(T°_i)$=efficiency of the treatment of hydrocarbons for richness less than 1 by the element An overall efficiency per pollutant and per mode of combustion is defined for the entire exhaust system:

$E\text{-}Exh_{R=1,HC}=\text{Sup}\ (E\text{-}Exh_{R=1,HC,i})$ $E\text{-}Exh_{R=1,NOx}=\text{Sup}\ (E\text{-}Exh_{R=1,NOx,i})$ $E\text{-}Exh_{R<1,HC}=\text{Sup}\ (E\text{-}Exh_{R<1,HC,i})$ $E\text{-}Exh_{R<1,NOx}=\text{Sup}\ (E\text{-}Exh_{R<1,NOx,i})$ An overall efficiency per combustion mode is defined for the pollutants and exhaust system as a whole.

$E\text{-}Exh_{R=1}=\text{Inf}\ (E\text{-}Exh_{R=1,HC};\ E\text{-}Exh_{R=1,NOx})$ $E\text{-}Exh_{R<1}=\text{Inf}\ (E\text{-}Exh_{R<1,HC};\ E\text{-}Exh_{R<1,NOx})$ An example of the behaviour of these various efficiencies is given in FIG. 9.

FIG. 9*a* represents the behaviour of the efficiency of the treatment of the exhaust line in respect of two elements, HC and NOx, for a mixture of richness 1.

FIG. 9*b* represents the behaviour of the efficiency of the treatment of the exhaust line with respect to two elements for a lean mixture.

FIG. 9*c* represents the overview of the behaviours of the treatment efficiencies depicted in FIGS. 9*a* and 9*b*.

The treatment efficiency is further modified when the efficiency of the catalytic treatment is taken into consideration.

The priority mode of combustion is authorized only if the overall efficiency of the exhaust system for the richness associated with the treatment mode is good enough to avoid emitting pollutants into the atmosphere.

If none of the efficiencies is good enough to allow the priority mode of combustion, a mode of combustion specific to cleaning up pollution is imposed.

This mode depends on the characteristics of the engine.

It may, for example, be homogenous-stratified charge two-stage injection with the ignition advance retarded.

Figure 10:
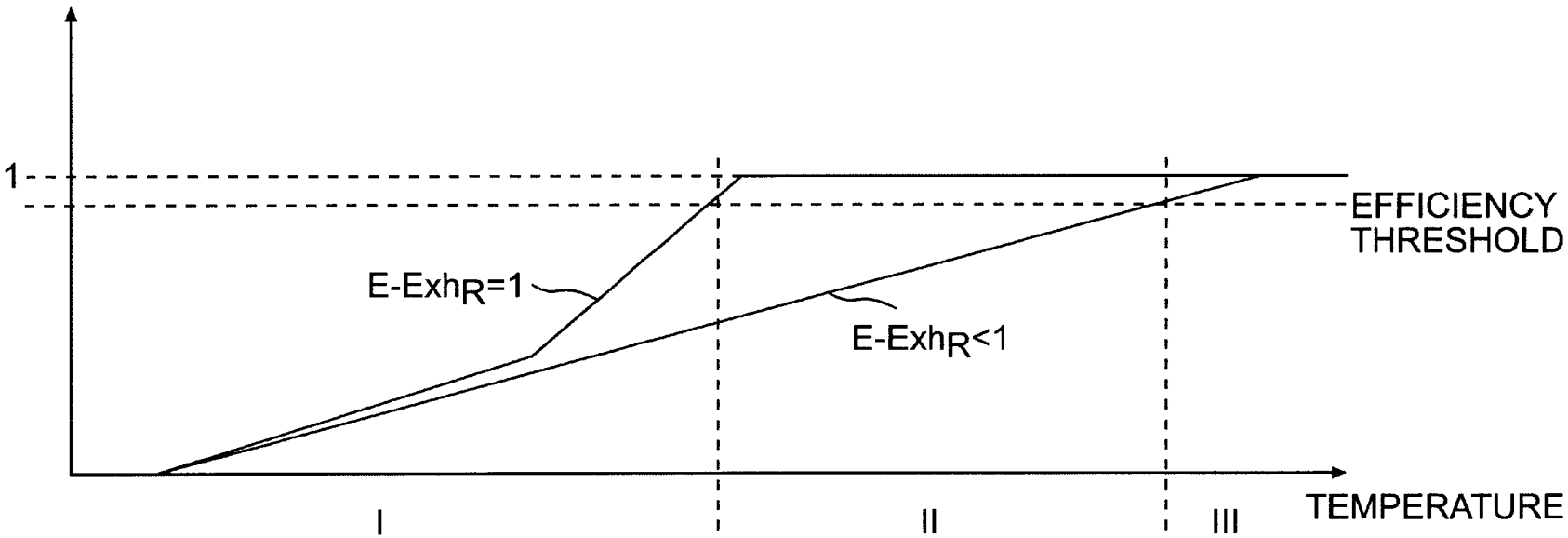
FIG. 10 is a graph of the account taken of the catalytic treatment.

An example of the choice of final mode of combustion is set out in FIG. 10.

The graph of FIG. 10 represents the behaviour of treatment efficiency of the exhaust line taking account of the catalytic treatment efficiency.

The graph is broken down into three regions, I, separated by vertical dotted lines intersecting the temperature axis.

In region I, the priority mode of combustion, whatever that might be, cannot be applied.

A specific mode of combustion intended to quickly increase the temperature of the exhaust system is imposed.

In region II, the priority mode of combustion can be applied if it allows operation at richness=1.

In region III, the priority mode of combustion can de applied.

What is claimed is:

1. A control device for controlling modes of combustion of a controlled-ignition four-stroke engine capable of operating in a plurality of combustion modes, a system being arranged for direct injection of fuel into a combustion chamber of the engine, and at least one catalytic converter being located in an exhaust line of the engine, the control device comprising:

a control system that receives information from sensors relating to a rotational speed of the four-stroke engine, a load of the engine, a position of an accelerator pedal, a temperature of the engine, and a temperature of engine exhaust gases, the control system comprising:

means for selecting a priority mode of combustion from the various modes of combustion using the information from the sensors and based on an estimate of the combustion efficiency of the various modes of combustion available to the engine.

2. The control device of claim 1, wherein the control system executes a control algorithm for calculating the combustion efficiency of the engine using a thermal condition of the combustion chamber.

3. The control device of claim 2, wherein the control algorithm operates to correct the priority mode of combustion using a switching efficiency capable of anticipating the behavior of a driver and avoiding ill-timed changes in combustion mode upon discrete changes of priority mode of combustion.

4. The control device of claim 2, wherein the control algorithm operates to anticipate the behavior of a driver on the basis of an analysis of engine reference torque values before and after application of filters which smooth out transitions in engine torque.

5. The control device of claim 3, wherein the control algorithm operates to anticipate the behavior of a driver on the basis of an analysis of engine reference torque values before and after application of filters which smooth out transitions in engine torque.

6. The control device of claim 2, wherein the control algorithm operates to correct the mode of combustion using a treatment efficiency of the catalytic converter as an engine temperature rises after the engine has been started.

7. The control device of claim 3, wherein the control algorithm operates to correct the mode of combustion using a treatment efficiency of the catalytic converter as an engine temperature rises after the engine has been started.

8. The control device of claim 4, wherein the control algorithm operates to correct the mode of combustion using a treatment efficiency of the catalytic converter as an engine temperature rises after the engine has been started.

9. A method for controlling the mode of combustion of a controlled-ignition four-stroke engine capable of operating in a plurality of combustion modes, a system being arranged for the direct injection of fuel into a combustion chamber of the engine, and at least one catalytic converter being located in an exhaust line of the engine, the method comprising:

receiving information at a control system, the information relating to a rotational speed of the four-stroke engine, a load of the engine, a position of an accelerator pedal, a temperature of the engine, and a temperature of engine exhaust gases;

estimating a combustion efficiency of various modes of combustion of the four-stroke engine; and selecting a priority mode of combustion from the various modes of combustion using the estimates of combustion efficiency and using the information relating to the rotational speed of the four-stroke engine, the load of the engine, the position of the accelerator pedal, the temperature of the engine, and the temperature of the engine exhaust gases.

10. The control device of claim 9, wherein estimating the combustion efficiency comprises:

executing an algorithm for calculating the combustion efficiency of the four-stroke engine using a thermal condition of the combustion chamber.

11. The control device of claim 10, wherein selecting a priority mode comprises:

using a switching efficiency to anticipate the behavior of a driver and to avoid ill-timed changes in combustion mode upon discrete changes of priority mode of combustion.

12. The control device of claim 10, wherein selecting a priority mode comprises:

anticipating the behavior of a driver on the basis of an analysis of engine reference torque values before and after application of filters which smooth out transitions in engine torque.

13. The control device of claim 11, wherein selecting a priority mode comprises:

anticipating the behavior of a driver on the basis of an analysis of engine reference torque values before and after application of filters which smooth out transitions in engine torque.

14. The control device of claim 10, wherein selecting a priority mode comprises:

correcting the mode of combustion using a treatment efficiency of the catalytic converter as engine temperature rises.

15. The control device of claim 12, wherein selecting a priority mode comprises:

correcting the mode of combustion using a treatment efficiency of the catalytic converter as engine temperature rises.

16. The control device of claim 14, wherein selecting a priority mode comprises:

correcting the mode of combustion using a treatment efficiency of the catalytic converter in the exhaust line as engine temperature rises.

* * * * *